US006836920B1

(12) United States Patent
Scannell

(10) Patent No.: US 6,836,920 B1
(45) Date of Patent: Jan. 4, 2005

(54) PLASTIC POP-TOP CAN LIP CLEANER

(76) Inventor: Timothy P. Scannell, 7974 Causeway Blvd. South, Saint Petersburg, FL (US) 33707

( * ) Notice: Subject to any disclaimer, the term of this patent is extended or adjusted under 35 U.S.C. 154(b) by 0 days.

(21) Appl. No.: 10/766,475

(22) Filed: Jan. 29, 2004

(51) Int. Cl.[7] ..... A47L 25/00

(52) U.S. Cl. ..... 15/104.94; 15/105; 15/210.1; 15/257.01; 7/151

(58) Field of Search ..... 15/104.93, 104.94, 15/105, 210.1, 236.09, 257.01; 7/151

(56) References Cited

U.S. PATENT DOCUMENTS

| | | | | |
|---|---|---|---|---|
| 4,185,754 A | | 1/1980 | Julius | 221/63 |
| 4,651,890 A | | 3/1987 | Coker et al. | 220/694 |
| 4,802,927 A | | 2/1989 | Barbour | 134/6 |
| 4,951,344 A | | 8/1990 | Alkhato | 15/257.01 |
| 5,031,264 A | | 7/1991 | Muster | 15/104.93 |
| 5,244,111 A | | 9/1993 | Merom | 220/694 |
| 5,371,913 A | * | 12/1994 | Smith | 15/104.94 |
| 5,507,052 A | | 4/1996 | Smith et al. | 7/151 |
| 5,996,169 A | | 12/1999 | Cooper | 15/257.01 |
| 6,276,013 B1 | * | 8/2001 | Hansen et al. | 7/151 |

* cited by examiner

*Primary Examiner*—Mark Spisich
(74) *Attorney, Agent, or Firm*—Richard C. Litman

(57) ABSTRACT

A pop-top can lip cleaner is compact in size, the cleaning element being generally "Y"-shaped, having a central portion from which an easily gripped handle extends upward and outward relative to the can top and rim, a generally horizontal inner leg portion having a lower side conforming with the top of and peripheral groove of the can, and a generally vertical depending leg portion extending downward along the outer lip of the can, the inner and vertical legs intersecting at the rim of the can. The inventive lip cleaner is provided with a disposable, pre-moistened towelette dispenser for dispensing towelettes of an appropriate size for use with the cleaning element. The handle may take the general form of a wedge, making it useful for opening the pop-top can.

20 Claims, 6 Drawing Sheets

PLASTIC POP-TOP CAN LIP CLEANER

BACKGROUND OF THE INVENTION

1. Field of the Invention

The present invention relates to cleaning devices. More particularly, the present invention relates to a pop-top can lip cleaner.

2. Description of the Related Art

Pop-top cans are widely used for the storage and consumption of soft drinks and other cold beverages. These cans often become contaminated with dirt and other debris during handling prior to consumption by the consumer. The narrow groove on the periphery of pop-top cans is not easily or conveniently cleaned. Cleaning the top of the can with a napkin, paper tower, or portions of clothing alone fails to produce adequate cleaning of surfaces coming in contact with the users mouth or lips.

U.S. Pat. No. 4,651,890, issued Mar. 24, 1987, to Coker et al., describes a beverage can wipe stored in a pouch affixed to the bottom of the can. This wipe is not configured to clean the more recent can designs having a deep circumferential groove.

U.S. Pat. No. 4,802,927, issued Feb. 7, 1989, to Barbour, describes a beverage can cleaner employing a sponge element fitting the entire top of the can where the sponge element is lowered onto the surface of the can and rotated to accomplish cleaning.

U.S. Pat. No. 4,951,344, issued Aug. 28, 1990, to Alkhato, describes a beverage can cleaning device which includes an element which is configured to and placed over the entire upper portion of the can with a paper towel between the can cleaning device and the can and the device and towel are rotated to accomplish cleaning.

U.S. Pat. No. 5,301,264, issued Jul. 16, 1991, to Muster, describes a pop-top can cleaning system where a pre-moistened pad is sealed under and opened upon operation of the can pull tab, the can then cleaned by rotation of the pull tab or release of the pad for manual wiping the can top, no specific provision being provided for cleaning the outer lip portion of the can.

U.S. Pat. No. 5,244,111, issued Sep. 14, 1993, to Merom describes a device which fits over the peripheral groove and lip of a pop-top can which is manually mounted and slid around the lip of the can.

U.S. Pat. No. 5,996,169, issued Dec. 7, 1999, to Cooper, describes a pop-top can cleaning device employing a pre-moistened towelette sealed at the base of the can, the cleaning device having a structure which allows the cleaning of the inner rim and groove of a pop-top can with the towelette.

U.S. Pat. No. 5,507,052, issued Apr. 16, 1996, to Smith et al., describes a rim cleaning beverage container opener which cleans the deep groove at the periphery of the can top, but makes no provision for cleaning the outer lip of the can.

U.S. Pat. No. 4,185,754, issued Jan. 29, 1980, to Julius, describes a disposable towelette dispenser capable of dispensing a number of moist towelettes.

It would be desirable to provide a compact, easily carried or stored pop-top can cleaning device which is easily grasped and fits the contours of the can peripheral groove, rim, and outer lip of the can and employs pre-moistened towelettes or paper toweling to provide a clean, sanitary rim and lip suitable for contact with the mouth and lips of the user. It would also be useful to provide such a device which is useful in opening the pop-top can. It would further be useful to provide such a device which is useful for a key chain or may be hung from a refrigerator door by means of a magnet attached by a chain to a ring mounted on the device. It would also be useful to provide a logo or advertising on the device, making it useful as a sales premium or the like.

None of the above inventions and patents, taken either singly or in combination, is seen to describe the instant invention as claimed. Thus a plastic pop-top can lip cleaner solving the aforementioned problems is desired.

SUMMARY OF THE INVENTION

The pop-top can lip cleaner of the present invention provides a compact cleaning element which may be carried in pocket or purse, or placed on a key chain or the like. The cleaning element is generally "Y"-shaped, having a central portion from which an easily gripped handle extends upward and outward relative to the can top and rim, a generally horizontal inner leg portion having a lower side conforming with the top of and peripheral groove of the can, and a generally vertical depending leg portion extending downward along the outer lip of the can, the inner and vertical legs intersecting at the rim of the can.

In a preferred embodiment, the inventive lip cleaner is provided with a disposable, pre-moistened towelette dispenser for dispensing towelettes of an appropriate size for use with the cleaning element. The towelette, paper toweling, cloth, or other appropriate web material is placed over the lip and rim of the can, extending inward along the can top and the inventive cleaning element pressed over the lip and rim. The cleaning element is then moved back and forth in an arc along the lip and rim along with the towelette so as to wipe and cleanse the area of the can coming into contact with the mouth and lips of the user.

The vertical depending leg portion is curved to conform with a conventional can. The inner leg portion has a groove-cleaning protrusion for reaching into the groove of the can, the protrusion being curved to conform with the can lid groove. The lip-receiving groove formed at the intersection of the two legs is curved to conform with the can upper rim. The cleaning element may have an aperture in the handle for receiving a key chain, a chain and refrigerator door magnet, a line and retracting reel, or the like for convenient storing and availability of the device for use. The cleaning element may be molded of appropriate plastic material or made of other materials as desired. The handle may take the general form of a wedge, making it useful for opening the pop-top can.

The invention provides improved elements and arrangements thereof for the purposes described which is inexpensive, dependable and fully effective in accomplishing its intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The pop-top can lip cleaner of the present invention provides a compact cleaning element which may be carried in pocket or purse, or placed on a key chain or the like. The cleaning element is generally "Y"-shaped having a central portion from which an easily gripped handle extends upward and outward relative to the can top and rim, a generally horizontal inner leg portion having a lower side conforming with the top of and peripheral groove of the can, and a generally vertical depending leg portion extending downward along the outer lip of the can, the inner and vertical legs intersecting at the rim of the can.

In a preferred embodiment, the inventive lip cleaner is provided with a disposable, pre-moistened towelette dispenser for dispensing towelettes of an appropriate size for use with the cleaning element. The towelette or paper toweling is placed over the lip and rim of the can, extending inward along the can top and the inventive cleaning element pressed over the lip and rim. The cleaning element is then moved back and forth in an arc along the lip and rim along with the towelette so as to wipe and cleanse the area of the can coming into contact with the mouth and lips of the user.

Referring to the Figures, there is shown an environmental perspective view of the pop-top can lip cleaning system 10 (FIG. 1) of the present invention including lip cleaning element 12, and towelette 14 in place on round peripheral lip R, lid L, peripheral groove G, and upper can rim U of pop-top can C. The can lip cleaning system is sized and configured to clean the contact surfaces of the can C which come in contact with the mouth and lips of the user during the drinking of the contents through the opening formed by the upward pulling of the opener O.

Figure 4:
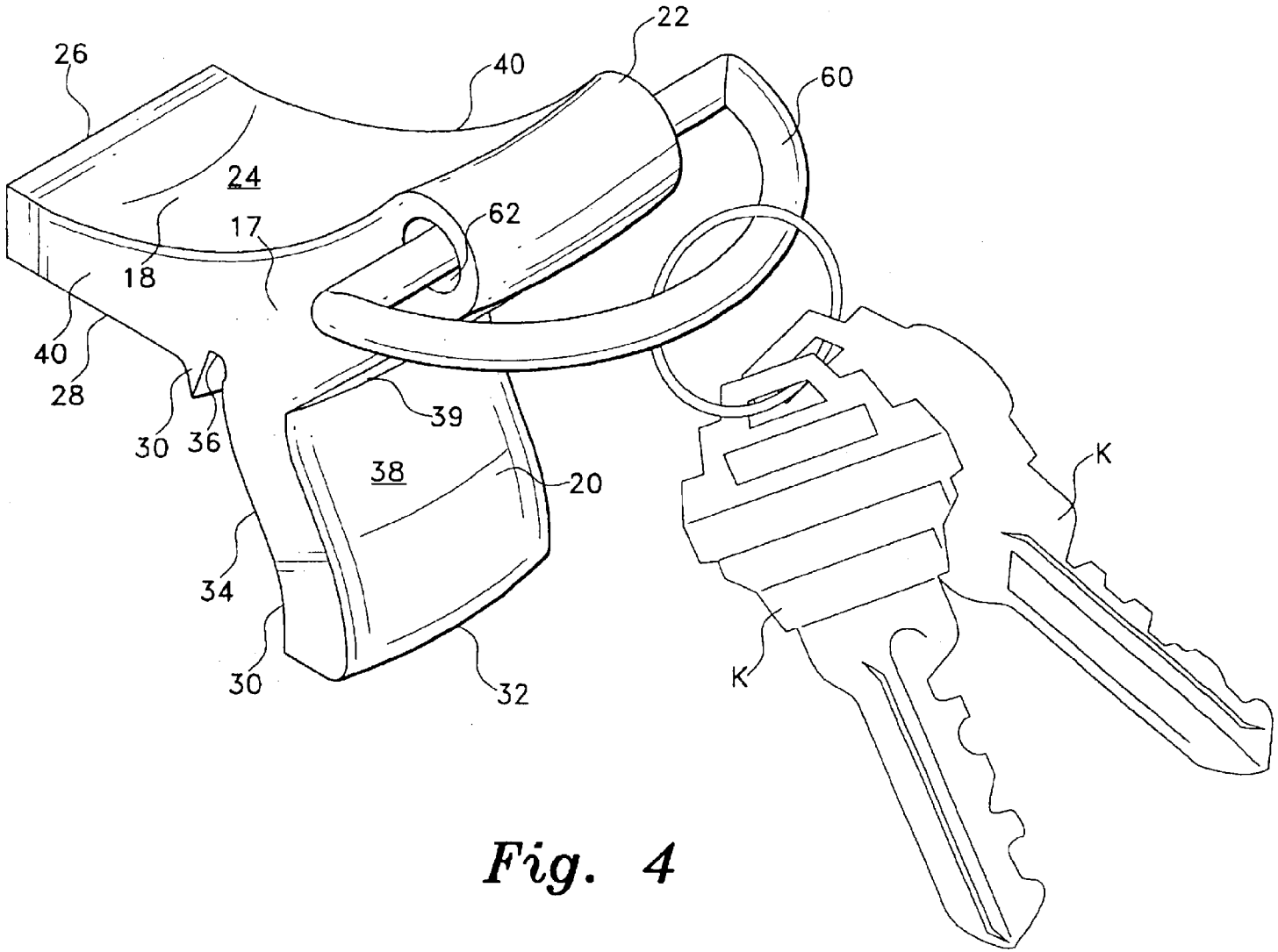
FIG. 4 is a perspective view of the inventive can lip cleaner with a key chain mounted through a hole in the handle.

As better seen in FIG. 4, cleaning element 12 is generally "Y"-shaped having a central portion 17 and a generally horizontal inner leg portion 18, a generally vertical depending leg portion 20, and a handle portion 22, each extending radially outward from the central portion 17 as determined relative to upright can C. Cleaning element 12 has a horizontal thickness convenient to grasp and sufficient to easily follow the lip R during reciprocal movement therealong and may be between about ½ to ¾ inches in width and preferably about +e,fra 518+ee inches in width. The horizontal inner leg portion 18 has an end 26 and a lower surface 28 which extends inward along the can lid surface a length adequate to clean the contact surface. Lower surface 28 has a groove protrusion 30 proximate the central portion 17 of the cleaning element 12 configured to conform with the peripheral groove G of a pop-top can C.

The vertically depending portion 20 has a curved inner surface 34 conforming with the upper lip surface of the can C and extending downward an appropriate length to lower end 32 so as to assure cleaning of the user contact surface of the upper wall of the can C. The horizontal portion 18 and the vertical portion 20 meet at the central portion 17, forming a curved lip receiver 36 conforming with the peripheral lip of the can C. The upper outer surfaces of horizontal portion 18 and handle 22 form a continuous concave surface 24. The outer surface 38 of depending vertical leg portion 20 and the lower outer surface 39 of handle 22 converge at an angle at central portion 17. The outer surface 38 may be curved to conform with inner surface 34 as desired.

Figure 1:
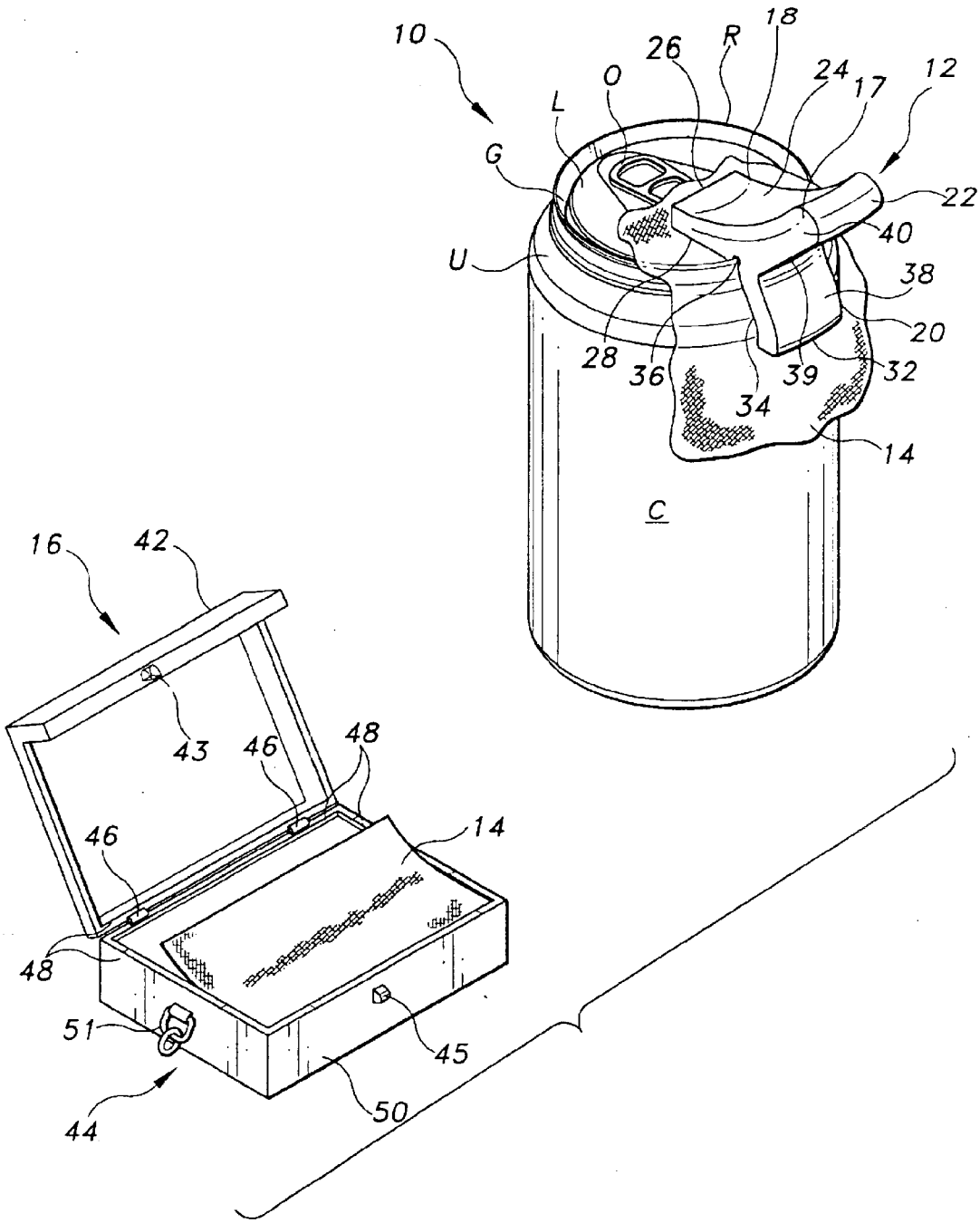
FIG. 1 is an environmental, perspective view of a pop-top can lip cleaner according to the present invention, including the towelette dispenser.
Figure 2:
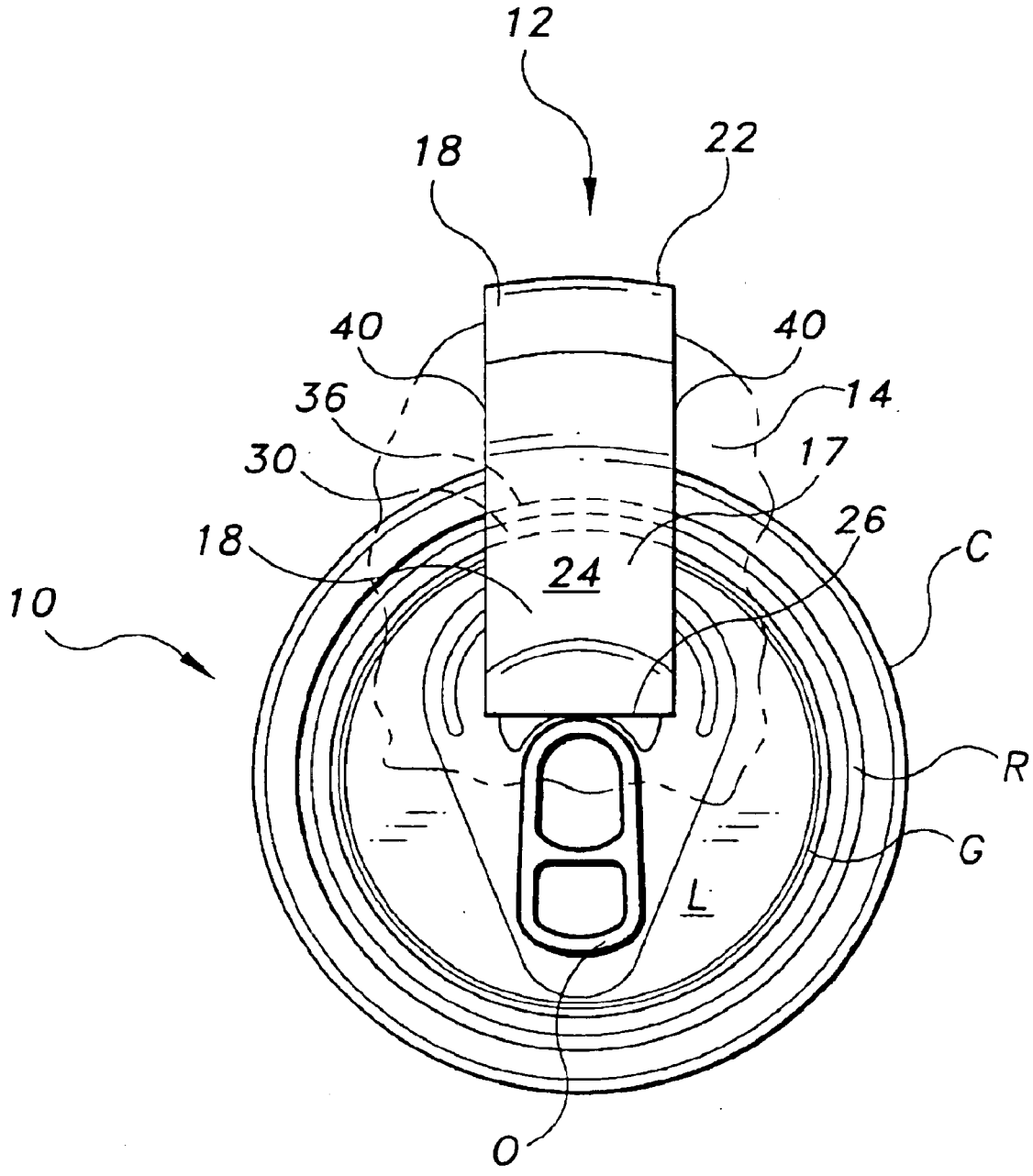
FIG. 2 is a plan view of the invention of FIG. 1.
Figure 3:
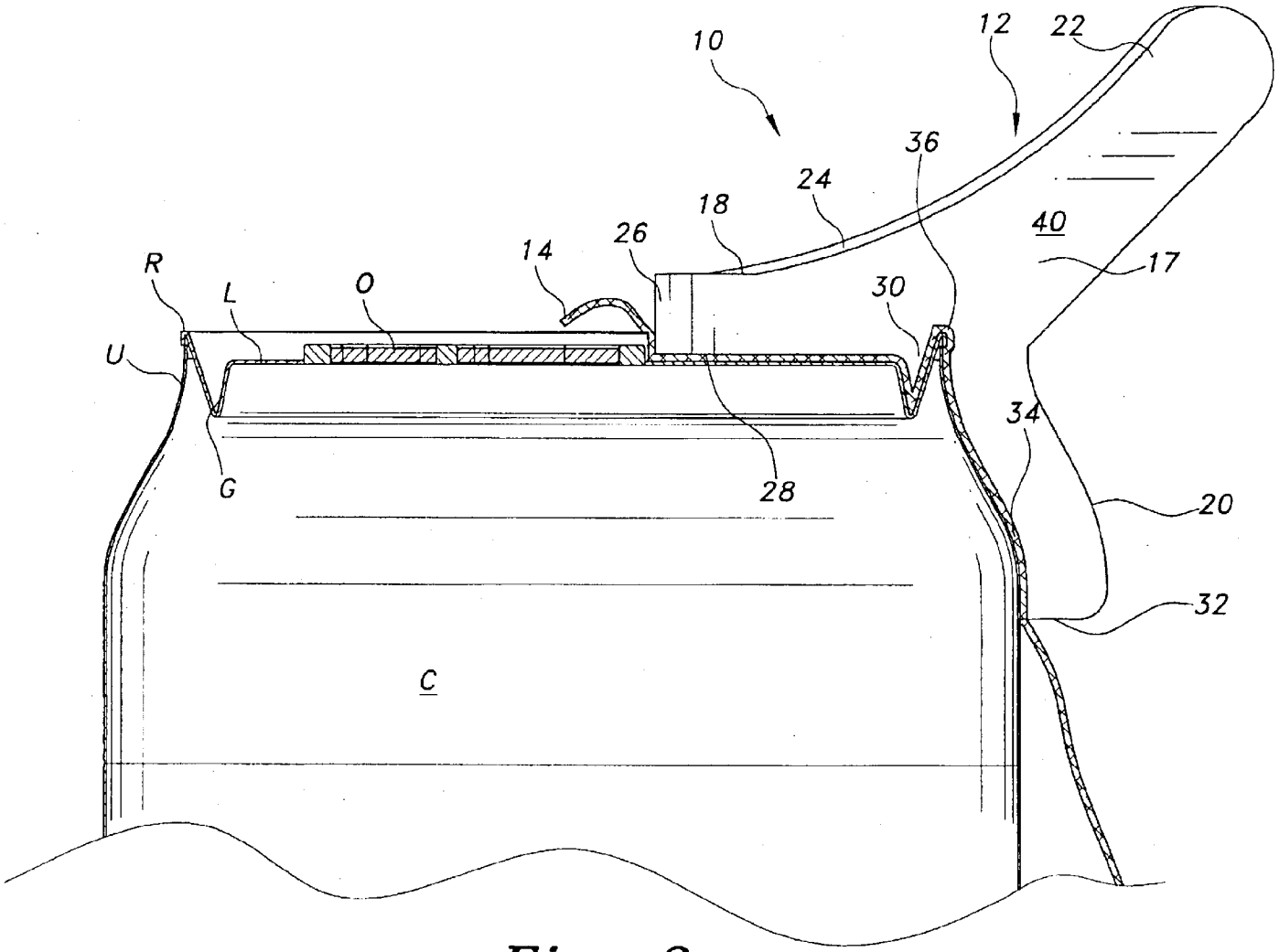
FIG. 3 is a sectional view of FIG. 1, along with towelette dispenser in its open position showing stored towelettes.

As shown in FIG. 4, handle portion 22 may have an aperture 62 through which a key ring 60 or the like may be threaded for convenient carrying of the cleaning element 12. As best seen in FIGS. 1–2, towelette 14 is located between the cleaning element 12 and the upper rim U, lip ring R, peripheral groove G, and can lid L of can C for cleaning lip and mouth contact surfaces. The cleaning action is performed by grasping the handle portion between thumb and finger, applying modest pressure against the can by pushing against the upper surface of the horizontal portion and the outer surface of the vertical portion, and then reciprocally, radially moving the cleaning element and, thereby, the towelette against the can surfaces, thereby cleaning the contact area for the user's lips and mouth.

A towelette dispenser 16 may be provided as a part of cleaning system 10 and may be of any convenient configuration. A dispenser 16 as shown is a plastic container having a lid 42, a box 44, and hinges 46, the container having end walls 48 and side walls 50 and is of such a size as to contain a supply of towlettes 14. The dispenser 16 has a latch receiver 45 on sidewall 50 opposite of hinges 46 and a latch 43 on the front of lid to make a tight seal when dispenser 16 is closed to maintain moisture in towelettes 14. The dispenser may be closed by hooks or snaps as desired in a known manner. The dispenser 16 may have an attachment point 51 such as a connecting ring on an end wall 48 for attachment to a chain or ring. A disposable towelette dispenser may be alternatively supplied such as that described in U.S. Pat. No. 4,185,745, issued Jan. 29, 1980, to Julius and hereby incorporated by reference. The liquid used in pre-moistening the towelette should be chosen for the intended use in the present invention and may be a liquid as discussed in U.S. Pat. No. 5,996,169 to Cooper as discussed in column 1–42 of the specification, the disclosure of which is hereby incorporated by reference. Dry paper towels, cloths, or other cleaning webs may also be used with the cleaning element of the present invention, however, they may not be as effective in providing a clean contact surface on the can as the towlettes.

As seen in FIG. 4, handle portion 22 may have an attachment ring 60 extending through an aperture or bore 62 through handle portion 22 for holding keys K or attachment of hanging devices by means of a chain attached to ring 60 such as a refrigerator magnet (not shown) or the towlette dispenser 16 by means of an attachment point 51 (see FIG. 6) for convenience of use. Alternatively, the aperture 62 may extend perpendicularly through the upper and lower surfaces of the handle portion 22 (see FIGS. 5 and 6).

Figure 5:
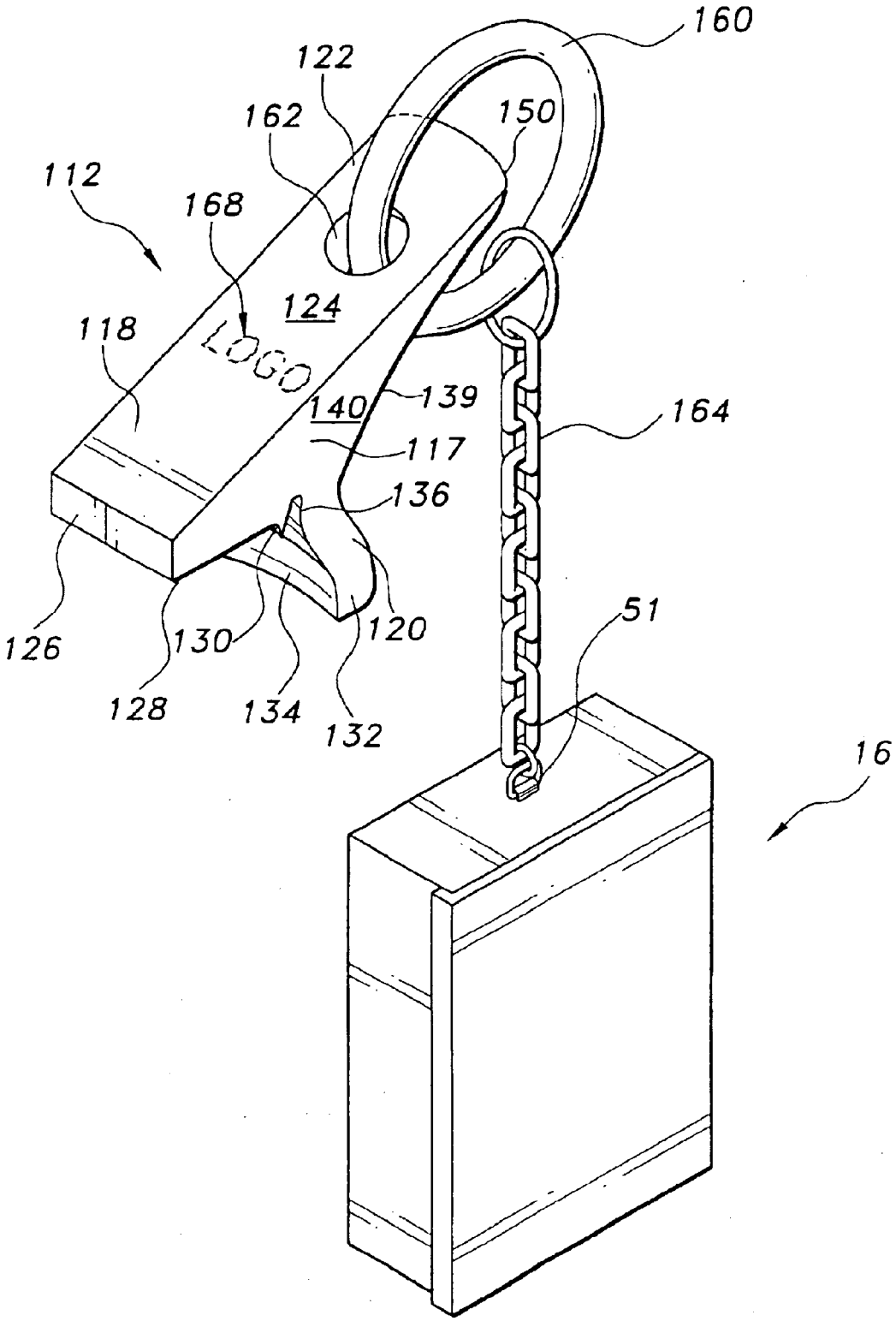
FIG. 5 is a perspective view of another embodiment of the invention also useful for opening a pop-top can.
Figure 6:
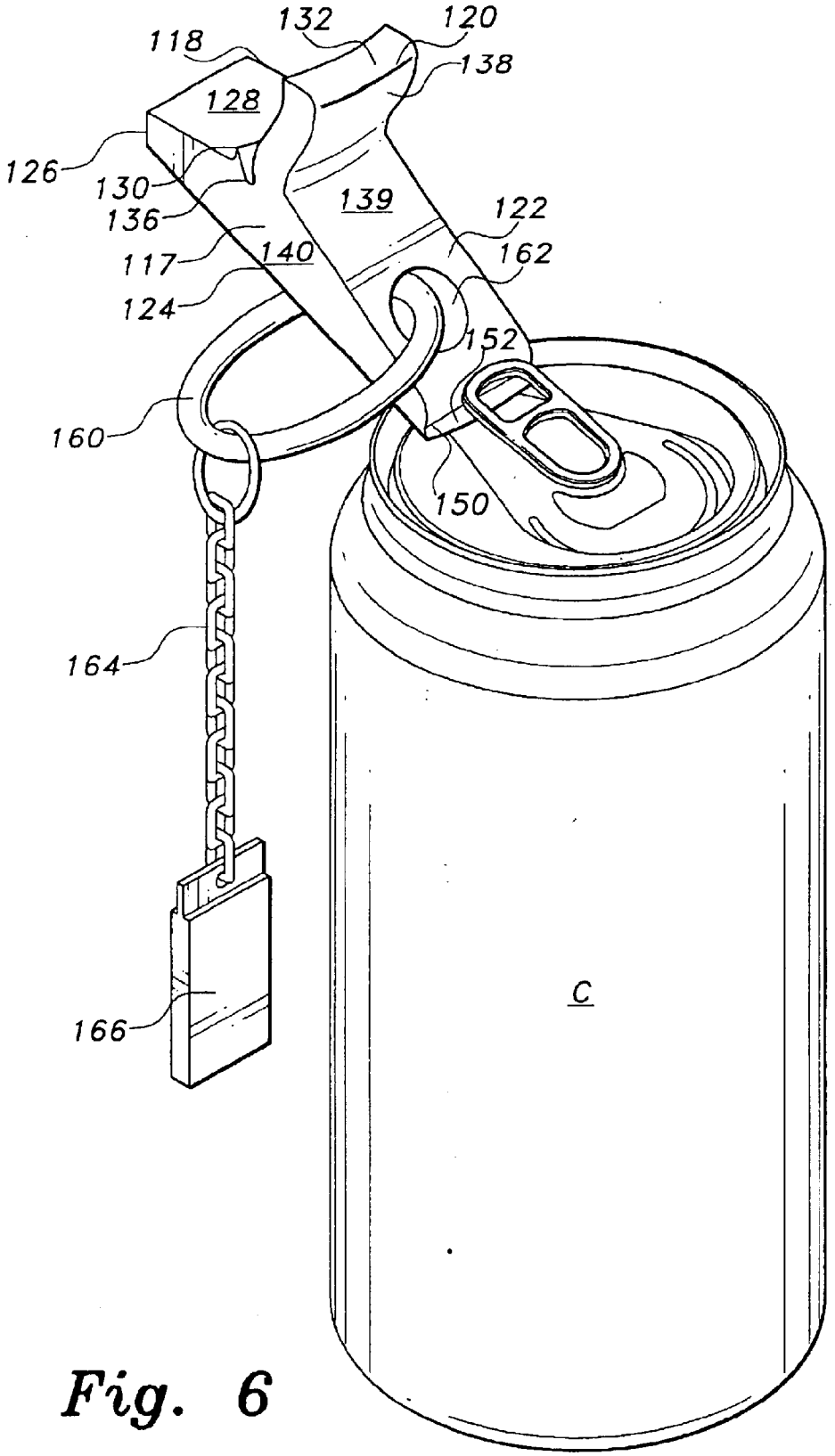
FIG. 6 is an environmental, perspective view of the embodiment of FIG. 5 in use for opening a pop-top can.

Referring to FIGS. 5 and 6, there is shown another embodiment of the pop-top can lip cleaner of the present invention where the handle is modified to serve as a wedge to aid in lifting the opener of the can once the can lip has been cleaned. Lip cleaner and opener device 112 is generally "Y"-shaped having a central portion 117, with a horizontal inner leg portion 118, a vertical depending leg portion 120, and a handle and opening wedge portion 122 extending outward from central portion 117. As shown a generally flat upper surface 124 is formed by the upper walls of inner leg portion 118 and handle and wedge portion 122, however this surface may be slightly concave or convex as desired.

Inner leg portion 118 has an inner end relative to the top T of can C and a lower surface conforming with the upper surface of the top T and has an inner leg groove protrusion 130 near central portion 117 extending down into the circumferential groove of the top T. Vertical depending leg portion 120 extends downward to lower end 132 and has an inner surface 134 conforming with the upper lip area of the can C so as to aid in cleaning the contact area with the mouth and lips of the user. A lip receiver 136 is formed at the intersection of horizontal inner leg portion 118 and vertical depending leg portion 120 so as to conform with the circumferential lip of can C.

A pre-moistened towelette, paper towel, or the like may be used in the manner of the first embodiment to clean the mouth contact surfaces of the can. The vertical depending leg portion outer surface 139 may be curved as desired to match the curve of the inner surface 134. The sidewalls of this embodiment are preferably flat with a width between sidewalls of about ⅝ inches. The handle and wedge end 150 is extended outward to a relatively sharp edge and may have a chamfer 152 for added strength in this area. An attachment ring 160 or the like may be inserted through a perpendicular aperture 162 in the handle and opening wedge 122 at a location spaced sufficiently from end 150 to avoid interference with its use in lifting the opener O of the can C. The attachment ring 160 may have a chain 164 for attachment of mounting magnet 166 for convenient storing of the lip cleaner device 112 on a refrigerator door where cold cans of beverage are kept, or other metal object as may be convenient. Such a chain and magnet or other storage device, such as towlette container 16 may be similarly used with the first embodiment described above. As shown, towlette container 16 may be attached to chain 164 by means of an attachment point 51 for easy access to towlettes. The handle and opening wedge 122 may have a clip (not shown) attached thereto by means of aperture 162 or attachment chain 164.

Other means of mounting the lip cleaner device 12 or 112 to a beverage machine, cooler, or other convenient location are contemplated by the present invention such as by chain 164 or retractable cord (not shown) or directly by ring 60 or 160, respectively. Other related items such as a bottle opener may be hung from chain 164 or by ring 60 or 160, respectively, or the handle 22 or handle and wedge 122 modified to accomplish such a function (not shown). Either embodiment of the invention as described above may be used with a napkin, cloth, paper towel, sanitary or antibacterial wipe, or other web of material as desired.

An advertising Logo or writing 168 may conveniently be displayed on the inventive cleaning device, the cleaning device being conducive to inexpensive production making it useful for an advertising premium or the like. The Logo 168 is most conveniently placed on the upper surface of the device as shown in FIG. 5 and may be included on the first embodiment in a similar manner.

The preferred material for making the cleaning element of the present invention is molded plastic, either hard or pliable as desired. Other materials, such as appropriate metals or wood may also be used as desired.

It is to be understood that the present invention is not limited to the embodiment described above, but encompasses any and all embodiments within the scope of the following claims.

I claim:

1. A pop-top can lip cleaner element having a generally "Y"-shaped body comprising:

a central portion;

a handle portion extending outward from said central portion to an outward end thereof;

a generally horizontally disposed lid and groove-cleaning inner leg portion extending inward from said central portion to an inner end thereof; and a generally vertically disposed upper lip-cleaning depending leg portion extending downward from said central portion to a lower end thereof;

said lid and groove-cleaning inner leg portion having a lower surface conforming with the shape of the lid and peripheral groove of a pop-top can;

said upper lip-cleaning depending leg portion having a curved inner surface conforming with the shape of the upper lip of a pop-top can; and said lid and groove-cleaning inner leg portion and said upper lip-cleaning depending leg portion forming a lip receiver at their intersection which is curved, conforming with the shape of the peripheral rim of a pop-top can;

whereby said cleaning element is useful for pressing a cleaning web against the exposed surfaces of a pop-top can which generally come into contact with the mouth and lips of the user when drinking therefrom, the cleaning being accomplished by the user grasping said handle portion and sliding said cleaning element and said web in a reciprocal backward and forward motion around the pop-top can lid within the contact area, thereby cleaning the contact area from dirt, debris, and other contaminants.

2. The pop-top can lip cleaner element of claim 1, wherein said "Y"-shaped body has a horizontal thickness adequate to allow easy grasping by the user and guided travel along the peripheral rim of the pop-top can.

3. The pop-top can cleaner element of claim 2, in combination with a pre-moistened towelette dispenser of such size as to dispense towlettes of the appropriate size for use with said pop-top can cleaner element.

4. The pop-top can cleaner element of claim 2, in combination with a web suitable for cleaning the contact surfaces of the pop-top can, said web being a pre-moistened towelette located between said can contact surfaces and said can cleaner element.

5. The pop-top can lip cleaner element of claim 1, wherein the outer surface of the combined said handle portion and said horizontally disposed lid and groove-cleaning inner leg portion form a concave, curved surface.

6. The pop-top can lip cleaner element of claim 1, wherein the outer surface of the combined said handle portion and said upper lip-cleaning depending leg portion converge at an angle.

7. The pop-top can lip cleaner element of claim 1, said handle portion defining a horizontal aperture therethrough proximate said end thereof.

8. The pop-top can lip cleaner element of claim 7, said aperture being of such size as to receive a key ring therethrough.

9. The pop-top can lip cleaner element of claim 8, further comprising a key ring inserted through said aperture.

10. The pop-top can lip cleaner of claim 7, further comprising an attachment ring inserted through in said aperture.

11. The pop-top can lip cleaner of claim 10, further comprising a chain attached to said attachment ring.

12. The pop-top can lip cleaner of claim 11, further comprising a magnet attached to said chain for removable attachment to a refrigerator door or other metal object.

13. The pop-top can lip cleaner of claim 11, further comprising a pre-moistened towelette dispenser of such size as to dispense towlettes of the appropriate size for use with said pop-top can cleaner element, said towelette dispenser being attached to said chain.

14. The pop-top can lip cleaner element of claim 1, wherein said handle portion is wedge-shaped, extending to a lateral edge at the end thereof, whereby said pop-top can lip cleaner element may be grasped by said horizontal inner leg portion and said lateral edge of said wedge-shaped handle pushed under the opener ring to pry open the opener, thus opening the can for use consumption of the contents.

15. The pop-top can lip cleaner of claim 14, wherein said lateral edge is beveled.

16. The pop-top can lip cleaner of claim 15, wherein said handle portion defines an aperture substantially perpendicular thereto for insertion of a key ring, said aperture being spaced from said lateral edge such that a key ring inserted therethrough does not interfere with its use as an opener.

17. The pop-top can lip cleaner of claim 16, further comprising a key ring inserted through said aperture.

18. The pop-top can lip cleaner of claim 16, further comprising an attachment ring inserted through in said aperture.

19. The pop-top can lip cleaner of claim 18, further comprising a chain attached to said attachment ring.

20. The pop-top can lip cleaner of claim 19, further comprising a magnet attached to said chain for removable attachment to a refrigerator door or other metal object.

* * * * *